US005302941A

United States Patent [19]

Berube

[11] Patent Number: 5,302,941

[45] Date of Patent: Apr. 12, 1994

[54] MULTI-SENSOR SECURITY/FIRE ALARM SYSTEM WITH MATED MASTER CONTROL

[75] Inventor: James E. Berube, Farmington, N.Y.

[73] Assignee: Detection Systems Inc., Fairport, N.Y.

[21] Appl. No.: 817,865

[22] Filed: Jan. 7, 1992

[51] Int. Cl.[5] ..... G08B 26/00

[52] U.S. Cl. ..... 340/505; 340/518

[58] Field of Search ..... 340/505, 518, 825.07-825.13, 340/825.36

[56] References Cited

U.S. PATENT DOCUMENTS

| | | | |
|---|---|---|---|
| 3,516,063 | 6/1970 | Arkin et al. | 340/518 |
| 3,713,142 | 1/1973 | Getchell | 340/505 |
| 3,806,872 | 4/1974 | Odom | 340/505 |
| 4,361,832 | 11/1982 | Cole | 340/505 |

*Primary Examiner*—Donnie L. Crosland
*Attorney, Agent, or Firm*—Warren W. Kurz

[57] ABSTRACT

A multi-sensor security/fire alarm system comprises a master control unit which repeatedly interrogates, e.g., by a multiplexing scheme, the respective inputs and/or operating status of a plurality of remote sensor units (e.g., intrusion and fire sensors). In response to an alarm or other off-normal condition detected by any of the remote sensors, the master control notifies an alarm-monitoring service which either responds itself to the detected condition, or notifies the local police or fire department. To prevent one alarm-monitoring service from taking over, without authorization, the alarm-monitoring accounts of another service which may have expended considerable time and expense in installing the system, the master control unit is mated with its associated sensors by a unique code. According to a preferred embodiment, each sensor comprises an EEPROM which stores a unique portion (e.g., a single digital bit) of a multibit security code which is collectively defined by the unique code portions of all the individual sensors and stored in memory of the control unit. The control unit periodically addresses the remote sensors to compare the "distributed code" with the code stored by the control unit.

8 Claims, 4 Drawing Sheets

MULTI-SENSOR SECURITY/FIRE ALARM SYSTEM WITH MATED MASTER CONTROL

CROSS-REFERENCE TO RELATED APPLICATIONS

Reference is made to the commonly assigned U.S. patent application Ser. No. 817,866, now U.S. Pat. No. 5,268,668 filed concurrently herewith in the name of James E Berube and entitled "SECURITY/FIRE ALARM SYSTEM WITH GROUP-ADDRESSING OF REMOTE SENSORS".

BACKGROUND OF THE INVENTION

The present invention relates to security/fire alarm systems of the type which are continuously monitored for alarms and other conditions that may require the immediate attention and/or servicing provided by a system-monitoring enterprise. More particularly, it relates to improvements in apparatus for discouraging the repudiation of a contractual arrangement between a system monitoring enterprise and a customer who has agreed to have such enterprise monitor the alarm and/or operating status of the system for a predetermined time period.

A security/fire alarm system dealer, under contract to an end user, will spend considerable time and effort in customizing the installation of a security/fire alarm system to suit the needs of his customer. Depending on the physical size and needs of a building requiring intrusion and/or fire protection, a suitable security/fire alarm system may comprise a wide variety, as well as a large number, of intrusion and fire sensors. These sensors must properly set-up and checked out at key locations throughout the building. Further, they must be connected by wires, referred to as a "bus", to a master control unit which, in the more sophisticated systems, operates to repeatedly interrogate the individual remote sensors by a digital address code which is unique to each remote sensor. Upon being interrogated or "addressed", each sensor transmits a communication to the master control unit indicating its alarm status and whether or not the sensor and its communication electronics are functioning properly. Two-way communication between the control unit and the remote sensors is in the form of digital electronic multiplexed signals and takes place over a communications "bus" which connects all remote sensors with the control unit. A security/fire system of this type is disclosed in the above-referenced U.S. patent application Ser. No. 817,866, filed concurrently herewith, the contents of such application being incorporated herein by reference.

In addition to contracting to install an alarm system, which an alarm system may either lease or sell to the customer, an alarm dealer will often contract with such customer to provide, for a monthly fee, a twenty-four hour per day system-monitoring service. Compared to the installation phase, the monitoring phase is considerably more profitable to the installer, and it is here that the installer can recover a large part of the installation cost. Obviously, the installer would like to monitor the system as long as possible, certainly, at least, for the agreed-upon term of the monitoring contract. However, it is sometimes the case that another system-monitoring enterprise will induce the customer to repudiate his monitoring contract with the installer in favor of a lower monthly service fee offered by the other enterprise. This lower service fee is usually made possible by the fact that the other enterprise has no installation costs to recover. To prevent this occurrence, manufacturers of master control units design them so that the system can only be programmed by a remote dial-in. Thus, to take over the monitoring account, one needs to know the correct phone number, an access code and a password. Since this information is known only to the original installer, unauthorized takeovers are discouraged. But this type of anti-takeover system can still be circumvented at modest cost by merely purchasing an identical control unit from the same manufacturer and connecting it to the existing wiring of an installed system. The enterprise taking over the account can then program the control unit to respond to a new phone number, access code and password.

SUMMARY OF THE INVENTION

In view of the foregoing discussion, an object of this invention is to provide a security/fire alarm system of the type described which makes it more difficult for one alarm dealer to take over, without authorization, the monitoring service of a system installed by another dealer.

Like the prior art, a preferred multi-sensor security/fire alarm system comprises a master control unit for repeatedly interrogating, e.g., by a multiplexing scheme, the respective inputs and/or operating status of a plurality of remote sensor units (e.g., intrusion and fire sensors). In response to an alarm or other off-normal condition detected by any of the remote sensors, the master control notifies an alarm-monitoring service which either responds to the detected condition itself or notifies the local police or fire department. Unlike the prior art, however, the security/fire alarm system of this invention is characterized by a security code that mates the control unit to each of the remote sensors. Preferably, each remote sensor comprises an EEPROM which stores a unique portion (e.g., a single digital bit) of a multibit digital code which is collectively defined by the unique code portions of all the individual sensors and stored in memory of the control unit. The control unit periodically addresses the remote sensors to compare the "distributed code" with the security code stored by the control unit. By distributing the security code among the sensors, the required memory capacity of each sensor is minimized, and the code security increases in proportion to the complexity and, hence, sophistication of the alarm system.

Other objects and advantages of the invention will become more apparent to those skilled in the art from the ensuing detailed description of preferred embodiments, reference being made to the accompanying drawings wherein like reference characters denote like parts.

DETAILED DESCRIPTION OF PREFERRED EMBODIMENTS

In the ensuing description, the expression "security/fire alarm system" refers to alarm systems of both types, i.e., fire and intrusion systems, as well as those systems which combine both intrusion and fire sensors.

Figure 1:
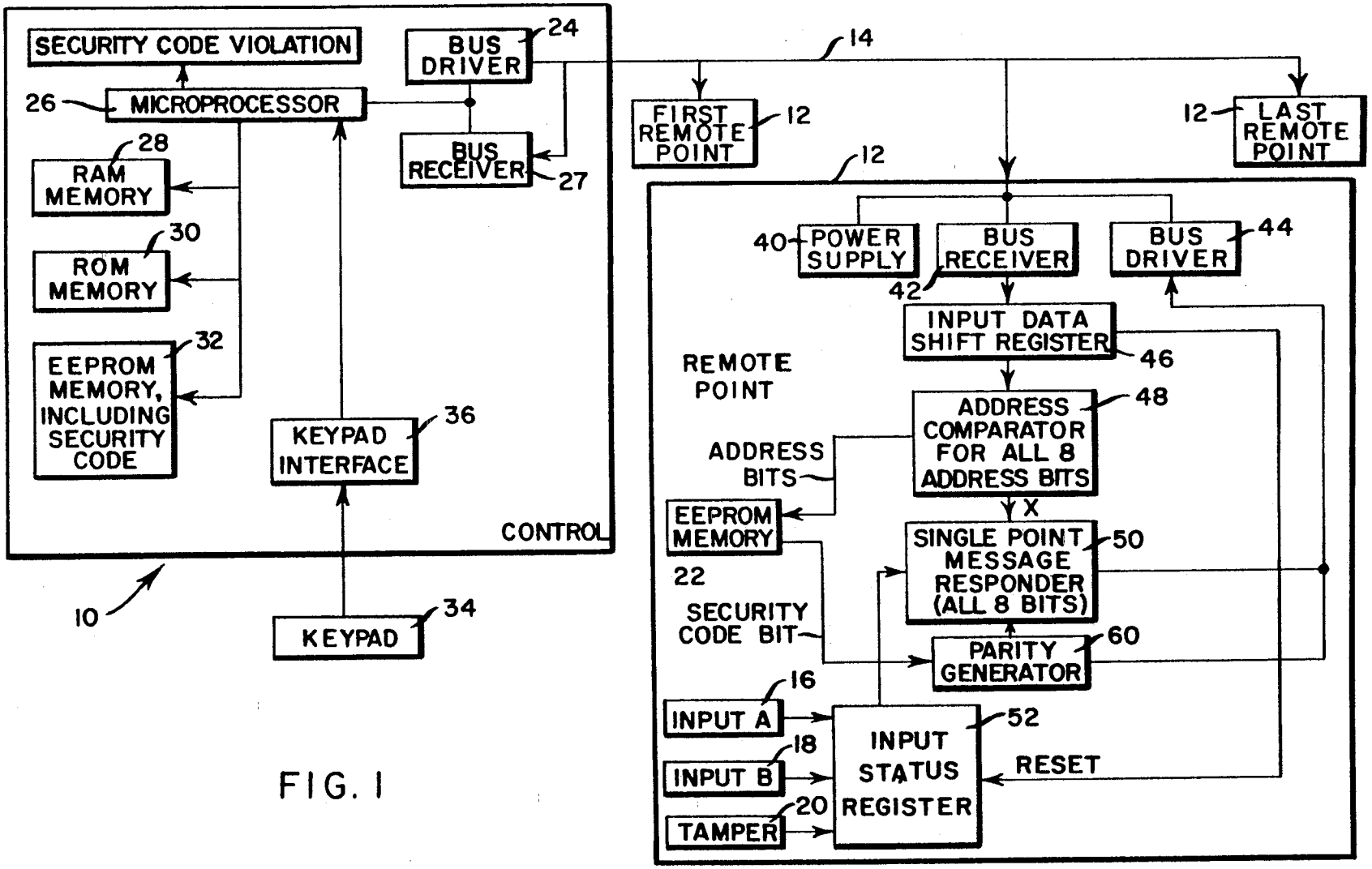
FIG. 1 is a block diagram of a microprocessor-based security/fire alarm system embodying the invention.

Referring to FIG. 1, a security/fire alarm system is shown to comprise a master control unit 10 which communicates with a plurality of remote event-sensing units 12 (e.g., intrusion, fire, smoke, etc... sensors) via a communications bus 14. The number of remote sensors depends, of course, on the specific application, and may typically comprise between 10 and 300 sensors. Each of the event-sensing units may comprise, for example, a pair of supervised inputs 16, 18 (e.g., from a passive infrared intrusion sensor and a microwave intrusion sensor) and tamper-monitoring input 20. Each of the event-sensing units is assigned its own binary address code which is stored in an Electrically Erasable programmable Read Only Memory (EEPROM) 22, and such an address code is typically defined by 8 binary bits.

Control unit 10 comprises a bus driver 24 which operates under the control of a conventional microprocessor 26 to repeatedly and sequentially interrogate the individual event-sensing units 12 on the bus. The control unit includes a bus receiver 27 for receiving communications from the remote sensors, a Random Access Memory (RAM) 28 for storing the status of each remote sensor upon being interrogated or "addressed" by the control unit, a Read Only Memory (ROM) which stores the program for interrogating the remote sensors (as explained below), and an EEPROM 32 which is a non-volatile memory for storing the detection and response characteristics of each remote sensor, e.g., whether it comprises a smoke-detector, an active or passive intrusion detector, a floor mat switch, a window switch, etc... The installer and customer interact with the control unit via a keypad 34 which, for example, turns the system "on" or "off" and stores information in EEPROM 32 through a keypad interface 36. As explained, it is EEPROM 32 that stores a multibit digital security code, preferably 20 bits in length, that mates each of the remote units so that neither the control unit nor any of the remote units that collectively store the same security code can be replaced without authorization by the system installer or monitoring service. This security code protects not only the system installer, but also assures the customer of the same quality of products as were originally installed.

Each of the event-sensing units 12, sometimes referred herein as "remote sensors" or "points", comprises a power supply 40, a bus receiver 42 and a bus driver 44. The bus receiver 42 of every remote sensor on the bus receives a multibit (e.g., 13 bit) interrogation signal from the control unit and transfers that signal to a shift register 46. An address comparator 48 compares the address signal in the shift register with the point-address stored in EEPROM 22 to determine whether that particular interrogation signal was intended for this particular remote sensor. If there is no match, the remote sensor ignores the transmission. If there is a match, however, the comparator produces an enable signal X which renders operative a single point message responder 50. The latter is operatively coupled to an input status register (a latching circuit) 52 which reflects the alarm/operating status of inputs 16, 18 and 20. The latching circuit 52 is selectively reset by one of the bits of the multibit interrogation signal produced by the control circuit.

In response to being addressed, the addressed point, via its respective bus driver 44, transmits an eight-bit response code to the control unit indicating its alarm/operating status, Five of the eight-bit response code are reserved for indicating the alarm/operating status of inputs 16,18*b* and 20. Two of these bits are start and stop bits. The remaining bit is a parity bit that indicates the response code's parity. In a default mode, every remote sensor will return a response code with the same parity, say, with odd parity. This parity bit is commonly used to detect errors in the response code. Where odd parity is required, and the alarm/operating inputs 16,18 and 20 are such as to produce an even number of logical "one's" in the response code, the parity bit will switch to logical "one" to maintain an odd parity in the response. If the parity of the response code is opposite that expected, the response code is considered as erroneous, and the point is readdressed.

Now, in accordance with a preferred embodiment of the present invention, the installer of the above system programs a twenty-bit security code into the EEPROM 32 of the control unit. As explained below, a unique portion of this code is stored in each of twenty different remote sensors, in the EEPROM 22 associated with each. Preferably each stored "portion" of the code is a single bit. Thus, the twenty-bit security code stored in EEPROM 32 is distributed in twenty different remote sensors. This one bit portion of the code is added to the aforementioned eight-bit address code stored in EEPROM's 22.

To program the twenty-bit security code into the EEPROM of the control unit, the installer uses the keypad 34 to enter a five digit number, i.e., any number up to 99,999. Each digit of this number can be represented by four bits of a binary code. Thus, it will be appreciated that the five digit number can be represented by twenty bits (i.e., 5 digits×4 bits each). To increase the likelihood that the stored security code will have a larger proportion of "ones" than "zeroes", which makes it easier to detect the code violations the code is stored in the following hexadecimal

| NUMERICAL DIGIT INPUT | HEXADECIMAL CODE |
|---|---|
| 0 | F (1111) |
| 1 | E (1110) |
| 2 | D (1101) |
| 3 | C (1100) |
| 4 | B (1011) |
| 5 | A (1010) |
| 6 | 9 (1001) |
| 7 | 7 (0111) |
| 8 | 6 (0110) |
| 9 | 5 (0101) |

As the remote sensors are installed, their respective EEPROM's are programmed with an eight-bit address code, and twenty of these remote sensors (preferably the first twenty remote sensors to be interrogated on the bus) are further programmed with one-bit of the twenty-bit security code stored in EEPROM 32 of the control unit. Preferably, the first twenty remote sensors on the bus are programmed as follows:

| BUS ADDRESS | SECURITY CODE PORTION |
|---|---|
| 1 | units digit, 1's bit |
| 2 | tens digit, 1's bit |
| 3 | hundred's digit, 1's bit |
| 4 | thousands digit, 1's bit |
| 5 | ten thousands digit, 1's bit |
| 6 | units digit, 2's bit |

-continued

| BUS ADDRESS | SECURITY CODE PORTION |
|---|---|
| 7 | tens digit, 2's bit |
| 8 | hundred's digit, 2's bit |
| 9 | thousands digit, 2's bit |
| 10 | ten thousands digit, 2's bit |
| 11 | units digit, 4's bit |
| 12 | tens digit, 4's bit |
| 13 | hundred's digit, 4's bit |
| 14 | thousands digit, 4's bit |
| 15 | ten thousands digit, 4's bit |
| 16 | units digit, 8's bit |
| 17 | tens digit, 8's bit |
| 18 | hundred's digit, 8's bit |
| 19 | thousands digit, 8's bit |
| 20 | ten thousands digit, 8's bit |

The security code bits are stored as indicated above so that if there are less than twenty remote sensors on the bus, in which case there are correspondingly fewer bits in the security code, portions of all five digits will be distributed among the remotes that are present. Also, these remotes that are present are more likely to have their security bit "set" (i.e. stored as a "one") and therefore will be sending even parity, as explained below, rather than the default odd parity. This makes security code violations easier to detect.

As indicated above, the EEPROM of each remote is programmed to store a parity bit which indicates whether the parity of the response code transmitted by the remote in response to being interrogated is to be odd or even. A particularly preferred feature of the present invention is to use this parity bit to reflect, by its logical state, that portion of the security code stored in the remote's EEPROM. If, for example, the first remote interrogated stores a logical "one" as its portion of the twenty bit security code stored in the control unit, then the response code of the first remote unit will be switched to "even" parity, and the control unit will look for an even number of "ones" in the eight-bit response code from the first remote sensor interrogated (i.e., the sensor having bus address 1). If, on the other hand, that portion of the security code stored by the first-addressed remote sensor is a "zero", then the response code transmitted by that sensor is sent at odd parity, and the control looks for an odd number of "ones" in the response code. Thus, unlike the prior art systems in which all remote sensors return a response code having the same parity, each of the first twenty remote sensors addressed in the system of the invention returns a response code in which the parity depends upon the logical state of the single bit representing the stored portion of the security code in that sensor. As shown in FIG. 1, the security bit stored in EEPROM 22 is used to control the output of a parity generator 60. Assuming the default parity is odd, if the stored security bit is "zero", the parity generator will control the logical state of the parity bit in the eight-bit response code to assure that the response has an odd number of "ones". If the stored security bit is a "one", the parity generator will control the parity bit to assure that the response code has an even number of "ones". Based on the security code stored in EEPROM 32, the control unit knows what parity to look for in the response code from the first twenty points interrogated. Thereafter, it will look for odd (default) parity.

From the foregoing, it will be seen that the security bits stored in the remote sensors are not queried directly to detect violations. Rather, violations are detected during normal processing by the control unit. By using this parity inverting scheme to indicate the logical state of the stored security bit, rather than adding an additional dedicated bit in the response code from each sensor, there is no transmission overhead in the detection scheme.

Figure 2:
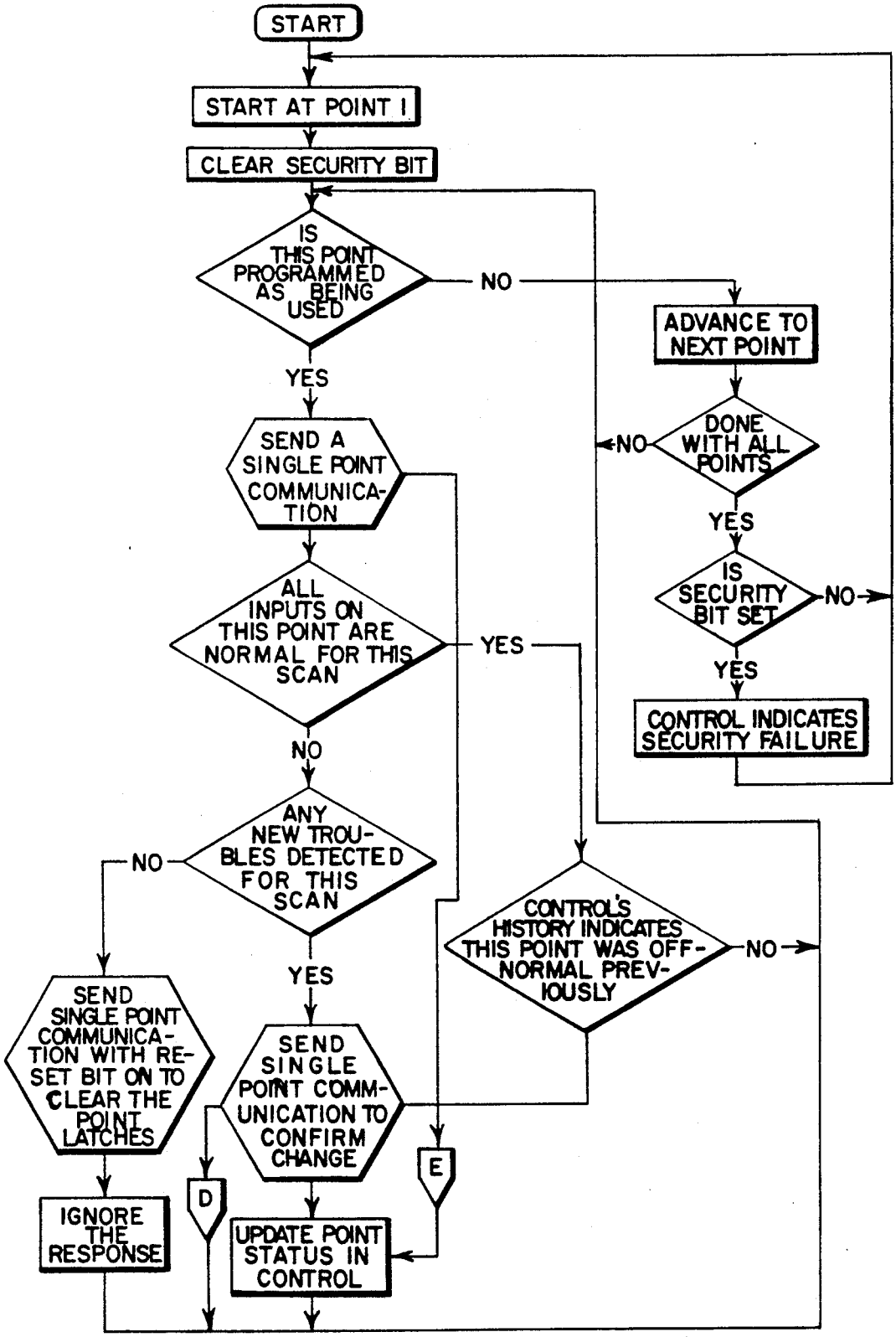
FIGS. 2-4 are flow charts illustrating the logical sequence of steps carried-out by the microprocessor in the FIG. 1 system.
Figure 3:
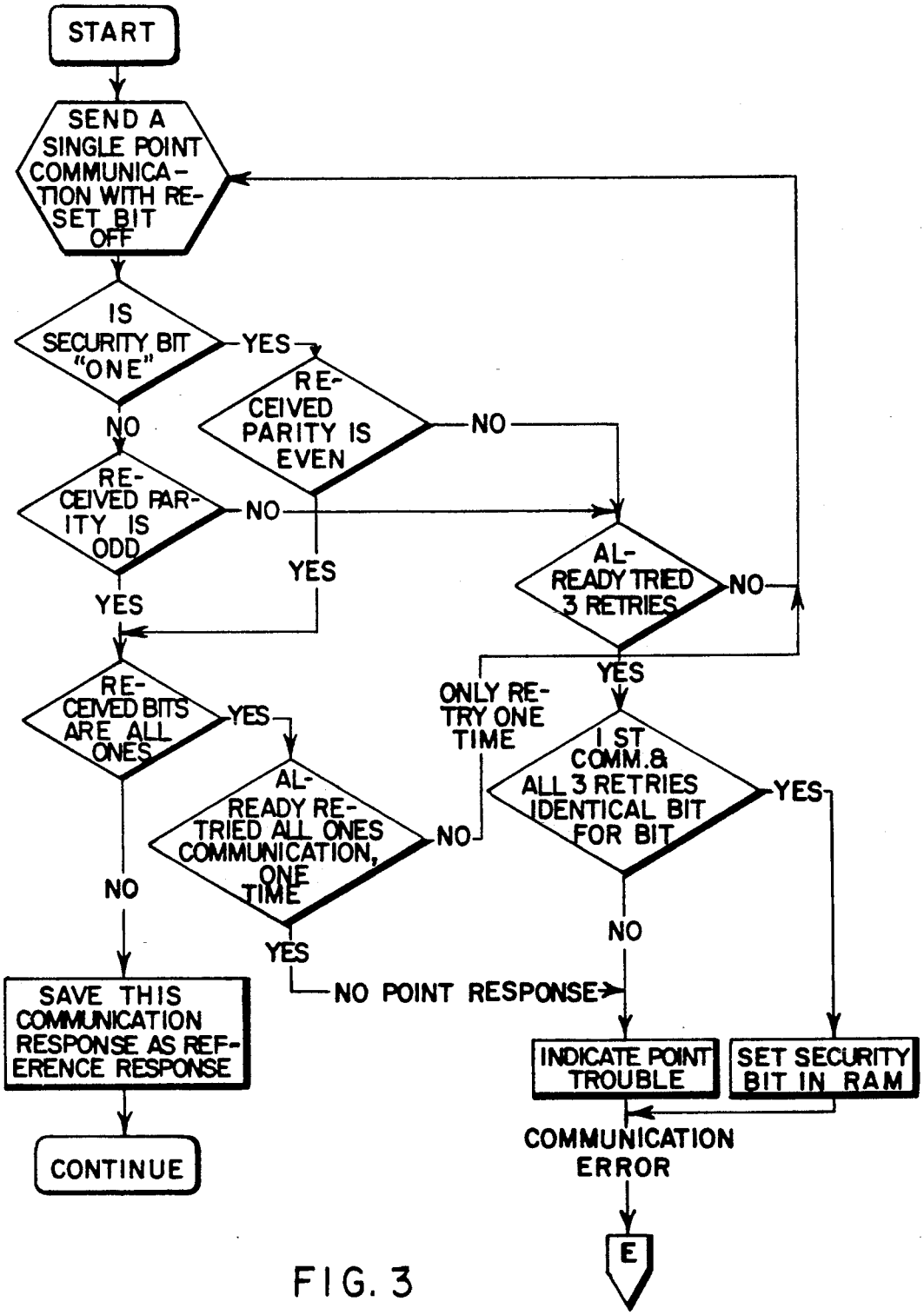
Figure 4:
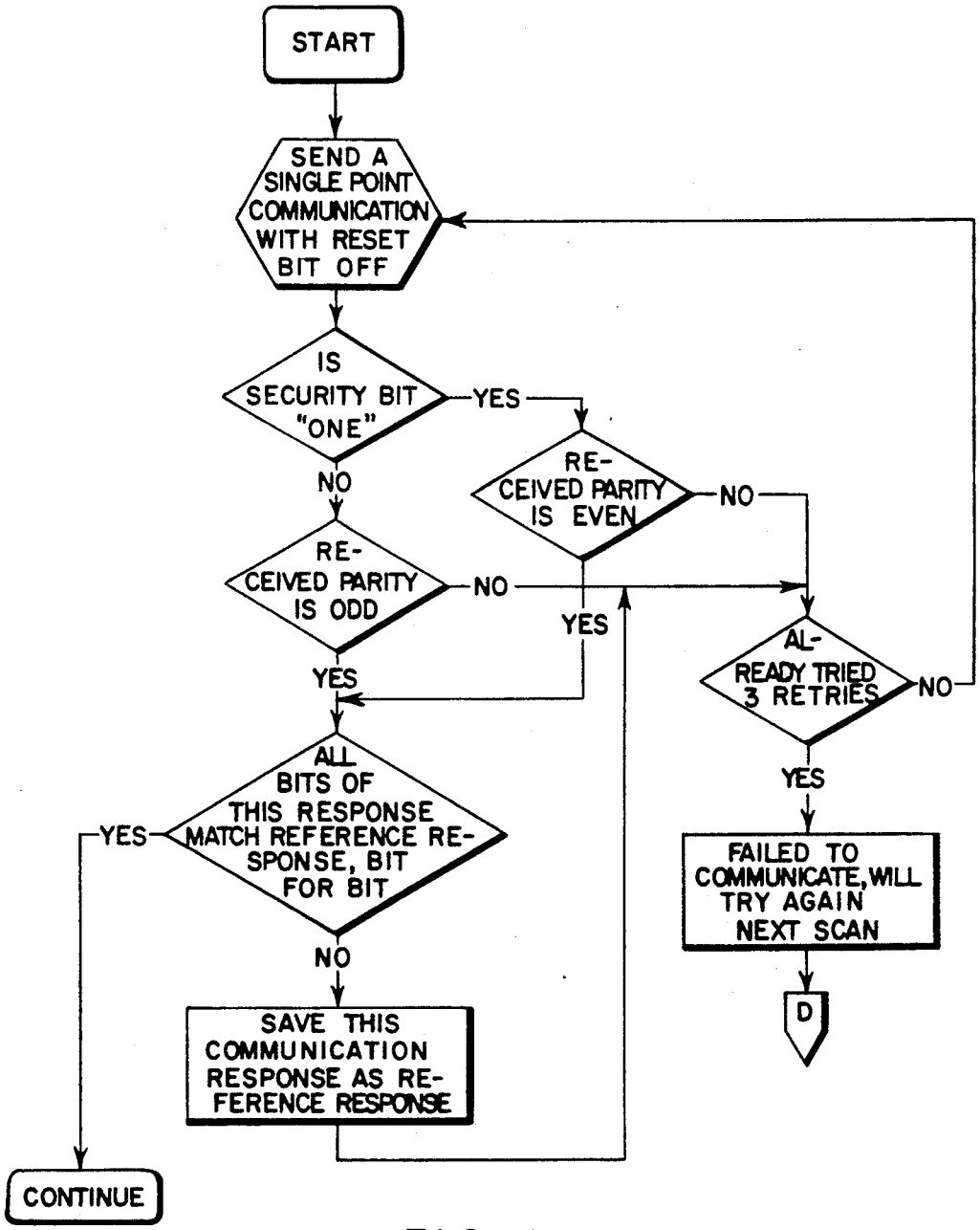

Referring to FIGS. 2-4, FIG. 2 illustrates the general sequence of steps carried-out by the microprocessor of the control unit in sequentially addressing the remote sensors 12 to ascertain their respective status and to determine whether there has been a violation of the security code, as may be occasioned by an unauthorized replacement of a remote sensor, or the control unit. FIGS. 3 and 4 illustrate certain details of the single point communication and status confirmation steps of the FIG. 2 process. The flow charts are self-explanatory.

Briefly, before a scan of the remote units can begin, a security bit stored in the control unit's RAM is cleared to indicate that no security code violation has occurred. This bit is "set" (i.e. made a "one") if there has been a security code violation during the previous scan of all remote sensors. Then, the microprocessor starts at the first address on the bus and asks whether the first point is programmed as being in use. If not, the program advances to the next point and the same question is asked until one of the points considered is in use. A single point communication is then sent by the control unit to the address of that particular point. As disclosed in the aforementioned U.S. patent application Ser. No. 817,866, such communication is in the form of a multibit (e.g., 13 bit) code which includes the point address and certain control bits, one of which is a "reset" bit which, when present, will reset latching circuit 52. Referring to FIG. 3, the control unit sends its multibit code (with the "reset" bit "off" so that the inputs 16 and 18 and tamper 20 indications are not reset) to the current point. The point responds with its eight-bit response code, as described above. The control unit asks, "Is the stored security bit a "one"? That is, is the EEPROM of this point programmed to store a logical "one" as a single bit of the twenty-bit security code? The answer to this question can be determined from the EEPROM of the control unit which stores the addresses of those points which store a security code bit, as well as the logical state of the stored bit. If the point does not store a security code bit, or if it does store such a bit but the logical state of such bit is "zero", then the parity of the response code should be odd. If the parity of the response code is indeed odd, and the received bits are not all "ones", then the transmitted response code is considered to be an accurate indication of the alarm/operating status of this point, and this point's status is saved in the RAM of the control unit. Note, if the parity is good, in this case odd, but all the received bits are "ones", this would indicate a communication problem since, for example, a broken wire will be seen as a continuous stream of "ones". In this case, the point communication is retried one more time. If the same result appears, then the control unit signals a point communication problem. If the parity of the response code is even from a point that stores a "zero" as part of the security code, then the control will retry its communication with the point. After three retries, and the same response code is produced, bit-for-bit, the control unit will set the "security bit" in the microprocessor's RAM, indicating a security code violation. If the response code parity is odd, but the bits of the code change from one retry to the next, the control unit will indicate point trouble., such as a communication problem.

Returning to FIG. 2, if the response code from a point indicates that all its inputs 16,18 and 20 are normal, the control compares this status with the point's previous status, as stored in RAM from the previous scan. If the control's RAM indicates that this point was normal during the previous scan, the control advances to the next point. If the RAM indicates that the current point had been "off-normal" during the previous scan, then the control sends a point communication to verify the now "normal" status. See FIG. 4. If the response code indicates that at least one of the inputs 16,118 and 20 are "off-normal", the control unit compares the the state of the inputs with the state during the previous scan(which is stored in RAM). If there are no new violations, then a point communication is sent in which the "reset" bit is "on" to clear the point's latching circuit 52. The point's response to this communication is ignored. If there are new violations detected during the current scan, then the control sends a point communication to confirm the change.

Referring to FIG. 4, to confirm a change in the status of inputs 16,18 and 20, the control readdresses the point with a multibit code. Here, again, the "reset" bit is "off" so as not to disturb the input status indicated in register (latch) 52. If this point store a "one" as a part of the distributed security code, the parity of the point's response code should be even. If it is, a check is made to see if all bits of the response code match the previous response, bit-for-bit. If so, the status of this point is updated in the control's RAM, and the process continues with the next point. If the point stores a "one" for the distributed security code, but the parity of the response code is odd, then the control retries the point communication up to three times. If the parity of the response code remains odd, the control will attempt to communicate during the next scan of all points. If the point stores a "zero" as part of the distributed security code, the parity of the response code should be odd. If it is, and all bits match the previous response code, the control's RAM is updated with the new status of the point's inputs. If the parity is even, however, up to three retries will be made to communicate with the point in an effort to obtain a response of odd parity. If these retries fail, the control will attempt to communicate again during the next scan.

The control unit will carry out the above processing until all points have been interrogated and their respective status stored in RAM. If, at any time during the scan of the individual points, a security code violation is indicated by a detection of improper parity in the response code of any point or points, the control unit will display the security code violation 62 at the end of the scan, thereby preventing the user from readily detecting which of the remote points was responsible for the security code violation. Preferably, the control is programmed to stop further scanning of the remote sensors in response to a security code violation.

The invention has been described with particular reference to preferred embodiments. It will be appreciated, however, that numerous modifications and variations can be made without departing from the true spirit of the invention. For example, rather than storing a single bit of a multibit security code in each of a plurality of sensors, the entire code, or a multiple bit portion thereof, could be stored in each sensor. Also, rather than using the parity of the response code as a vehicle for indicating the state of the stored single bit of the security code, the response code could include an extra bit to provide this information. Such modifications and variations ar intended to fall within the scope of the appended claims.

What is claimed is:

1. In a security/fire alarm system of the type comprising a plurality of event-sensing units distributed throughout a region to be protected by such systems, each of said event-sensing units being connected to a communications bus and being addressable individually by a multibit digital address code which is unique to each event-sensing unit; and a master control unit operatively connected to each of said event-sensing units via said communications bus, said master control unit being adapted to communicate with each of said event-sensing units by transmitting an appropriate multibit digital address code on said bus, each of said event-sensing units being responsive to being addressed by said master control unit to transmit a multibit response code indicating its alarm/operating status, the improvement comprising:

(a) first memory means associated with said master control unit for storing a multibit security code comprising several different portions;

(b) second memory means associated with each of said event-sensing units, said second memory means functioning to store information representing one of said several different portions of said multibit security code, said several different portions of the security code stored by said second memory means of said event-sensing units collectively defining the multibit security code stored by said first memory means, each of said event-sensing units being responsive to being addressed to transmit or said bus information representing its stored portion of said multibit security code; and (c) means associated with said master control unit for comparing its stored multibit security code with the portions of said security code transmitted by said event-sensing units, said comparing means being adapted to produce an indication that said stored security code does not match the security code collectively defined by the portions of the security code transmitted by the addressed event-sensing units.

2. The apparatus as defined by claim 1 wherein the portion of the security code stored by the second memory means of each event-sensing unit consists of a single binary bit.

3. The apparatus as defined by claim 2 wherein one bit of said multibit response code is a parity bit used for detecting errors in said response code, and wherein the single binary bit portion of the security code stored in said second memory means of each event-sensing unit is communicated to said master control unit via said parity bit.

4. The apparatus as defined by claim 3 wherein said security code is stored in said first memory means in a hexadecimal form to increase the number of event-sensing units that return a non-default state of the parity, thereby facilitating the detection of security code violations.

5. The apparatus as defined by claim 1 wherein said comparing means is adapted to prevent further communication with said event-sensing units after all of said event-sensing units have been interrogated, whereby the specific event-sensing units which transmits an incorrect portion of said security code are not readily identifiable.

6. In a security/fire alarm system of the type comprising a plurality of event-sensing units distributed throughout a region to be protected by such system, each of said event-sensing units being connected to a communications bus and being addressable individually by a multibit digital address code which is unique to each event-sensing unit; and a master control unit operatively connected to each of said event-sensing units via said communications bus, said master control unit being adapted to communicate with each of said event-sensing units by transmitting an appropriate multibit digital address code on said bus, each of said event-sensing units being responsive to being addressed by said master control unit to transmit a multibit response code indicating its alarm/operating status, the improvement comprising:

(a) first memory means associated with said master control unit for storing a multibit security code comprising several different portions;

(b) second memory means associated with each of said event-sensing units for storing information representing one of said several different portions of said security code, each of said one of said several different portions of the security code stored by each of said event-sensing units comprising a single parity bit used to detect errors in the response code, said parity bit stored by each event-sensing unit partially defining the multibit security code stored by said first memory means, said event-sensing units being responsive to being addressed to transmit on said bus its respective parity bit representing its stored portion of said multibit security code; and (c) means associated with said master control unit for comparing its stored multibit security code with the parity bits transmitted by said event-sensing unit, said comparing means being adapted to produce an indication that said stored security code does not match the security code collectively defined by the parity bits transmitted by the addressed event-sensing units.

7. The apparatus as defined in claim 6 wherein said security code is stored in said first memory means in a hexadecimal form to increase the number of event-sensing units that return a non-default state of the parity, thereby facilitating the detection of security code violations.

8. The apparatus as defined in claim 6 wherein said comparing means is adapted to prevent further communication with said event-sensing units after all of said event-sensing units have been interrogated, whereby the specific event-sensing units which transmit an incorrect portion of said security code are not readily identifiable.

* * * * *